US008042647B1

(12) United States Patent
Layton, Jr.

(10) Patent No.: US 8,042,647 B1
(45) Date of Patent: Oct. 25, 2011

(54) SPEAKER SIDE AIR SUPPLY

(75) Inventor: Robert Layton, Jr., Canton, MI (US)

(73) Assignee: Robert Layton, Jr., Canton, MI (US)

( * ) Notice: Subject to any disclaimer, the term of this patent is extended or adjusted under 35 U.S.C. 154(b) by 0 days.

(21) Appl. No.: 12/405,134

(22) Filed: Mar. 16, 2009

(51) Int. Cl.
*H04R 1/02* (2006.01)

(52) U.S. Cl. ..... 181/152; 181/199

(58) Field of Classification Search ..... 181/152, 181/155, 156, 177, 179, 182, 199; 381/340, 381/350, 160
See application file for complete search history.

(56) References Cited

U.S. PATENT DOCUMENTS

| | | | | | |
|---|---|---|---|---|---|
| 2,872,516 | A | | 2/1959 | Hoffman | |
| 3,356,179 | A | * | 12/1967 | Tompkins | 181/152 |
| 3,554,313 | A | | 1/1971 | Young | |
| 3,912,866 | A | | 10/1975 | Fox | |
| 3,952,159 | A | | 4/1976 | Schott | |
| 4,033,431 | A | | 7/1977 | Ebejer | |
| 4,122,302 | A | | 10/1978 | Bobb | |
| 4,213,515 | A | | 7/1980 | Laupman | |
| 4,413,703 | A | | 11/1983 | Kato et al. | |
| 4,437,540 | A | | 3/1984 | Murakami et al. | |
| 4,591,020 | A | * | 5/1986 | Hruby, Jr. | 181/145 |
| 4,635,749 | A | * | 1/1987 | Tattersall | 181/152 |
| 4,750,585 | A | * | 6/1988 | Collings | 181/148 |
| 4,923,031 | A | | 5/1990 | Carlson | |
| 4,957,184 | A | | 9/1990 | Negishi | |
| 5,125,031 | A | | 6/1992 | Ledonne | |
| 5,204,501 | A | | 4/1993 | Tsao | |
| 5,233,136 | A | * | 8/1993 | Hamada | 181/152 |
| 5,266,752 | A | * | 11/1993 | Cussans | 181/155 |
| 5,502,772 | A | | 3/1996 | Felder | |
| 5,749,433 | A | | 5/1998 | Jackson | |
| 6,094,495 | A | * | 7/2000 | Rocha | 381/340 |
| 6,744,902 | B2 | * | 6/2004 | Proni | 381/386 |
| 7,162,049 | B2 | * | 1/2007 | Polk, Jr. | 381/345 |
| 7,433,483 | B2 | | 10/2008 | Fincham | |
| 2006/0291684 | A1 | * | 12/2006 | Chick et al. | 381/349 |

FOREIGN PATENT DOCUMENTS

| | | | |
|---|---|---|---|
| JP | 57045796 | | 3/1982 |
| JP | 03235497 | A * | 10/1991 |
| JP | 4535500 | | 4/1992 |
| JP | 05344577 | A * | 12/1993 |
| JP | 05344578 | A * | 12/1993 |
| JP | 2007166589 | | 6/2007 |
| WO | WO93/07729 | | 4/1993 |

* cited by examiner

*Primary Examiner* — Jeremy Luks

(57) ABSTRACT

A Speaker Side Air Supply Cabinet that has three things that are working together the Speaker Side Air Supply ducts, the Front Air Chamber, and the Bass Horn. The Front Air Chamber takes in air then compress it so that we get a very high sound pressure {sound wave} output, and the Speaker Side Air Supply ducts supply all the air the Front Air Chamber needs. At the same time the Speaker Side Air Supply ducts also supplying air to the Bass Horn working together to eliminate the pull back on the out going sound wave so there is no reduction of the very high sound wave volume output.

14 Claims, 7 Drawing Sheets

PROVIDING A NEGITIVE SIGNAL TO THE SPEAKER CONE IT START MOVING IN AN INWARD DIRECTION

GENERATING A VACUUN AT THE SKEAKER CONE AND IN THE FRONT AIR CHAMBER

GENERATING A VACUUM IN THE RESTRICTOR PLATE OPENING

GENERATING A VACUUM IN BOTH OF THE TRANSITION ZONES AND IN BOTH OF THE SPEAKER SIDE AIR DUCTS

THE VACUUM IN BOTH THE SPEAKER SIDE AIR DUCTS DRAWS IN AIR FROM OUT SIDE BOTH SIDES OF THE CABINET TO THE FRONT AIR CHAMBER SO IT CAN COMPRESS IT FOR A HIGHER SOUND WAVE OUTPUT

PROVIDING A POSITIVE SIGNAL TO THE SPEAKER CONE IT START MOVING IN AN OUTWARD DIRECTION

GENERATING A POSITIVE AIR PRESSURE AT THE SPEAKER CONE AND IN THE FRONT AIR CHAMBER

GENERATING A POSITIVE AIR PRESSURE {SOUND WAVE} AT THE RESTRICTOR PLATE OPENING AND THEN GOING OUT THE THROUGH THE BASS HORN

THE SOUND WAVE THEN MOVING FORWARD OUT THE BASS HORN GENERATES A VACUUM IN BOTH THE TRANSITION ZONES THEN IN BOTH OF THE SPEAKER SIDE AIR DUCTS AND DRAWING IN AIR FROM OUT SIDE THE CABINET

REPEATING CYCLES INCREASES THE VACUUM THE SPEAKER SIDE AIR DUCT THEN PROVIDES ALL THE AIR NEEDED TO THE BASS HORN TO ELIMINATE THE PULL BACK ON THE SOUND WAVE AND SUPPLY ALL THE AIR NEEDED TO THE FRONT AIR CHAMBER AT THE SAME TIME; THIS RESULTING IN AN INCREASED OUTPUT OF CLEAN LOW BASS

FIG.7

SPEAKER SIDE AIR SUPPLY

BACKGROUND OF THE INVENTION

1. Field of the Invention

The present invention relates to speaker cabinet technology And, more specifically it relates to a Speaker Side Air Supply Cabinet, comprising of a Front Air Chamber that compress the air for a higher sound pressure output, and a Bass Horn that eliminates the pull back on the out going sound wave. Both of these are able to accomplish this with help of the Speaker Side Air Supply ducts that supply the air that both of them needs to do their jobs. All three working together gives us an increased output of clean low bass.

Speaker in prior art have pulled back on the sound wave resulting in the decreased bass output. The present invention overcomes these shortcomings by provide the Speaker Side Air Supply ducts to draw in air from out side the cabinet to eliminate the pull back on the sound wave and supply air to the Front Air Chamber at the same time.

2. Description of the Prior Art

There are other speaker cabinet technologies that may be suitable for specific individual purposes to which they address, they would not be suitable for the purposes of the present invention.

SUMMARY OF THE PRESENT INVENTION

A primary objective of the present invention the Speaker Side Air Supply cabinet having a pair Speaker Side Air Supply ducts to draw in air from out side the cabinet to the Distribution Zones.

An additional objective is to provide a Speaker Side Air Supply Cabinet having a pair of Distribution Zone to provide air to ether the Front Air Chamber or the Bass Horn.

Yet an additional objective is to provide a Speaker Side Air Supply Cabinet having a speaker with the front of the Speaker Cone and a Restrictor Plate with an opening that is sealed together to make up the Front Air Chamber that allow it to compress the air and produce a higher sound pressure output.

Still yet an addition objective is to provide a Speaker Side Air Supply Cabinet having a Bass Horn with Speaker Side Air Duct to eliminate the pull back on the sound wave and distribute the sound.

An additional objective is to provide a Speaker Side Air Supply Cabinet having Bass Reflex to release the back pressure on the Speaker Cone that allows the Front Air Chamber to draw in even more air to increase the output of the sound wave even more.

A further objective is to provide a Speaker Side Air Supply Cabinet that is simple and easy to use.

A still further objective is to provide a Speaker Side Air Supply Cabinet that is economical in cost to manufacture and to operate.

Additional objective of the present invention will be shown as the description proceeds.

The present invention overcomes the shortcomings of the prior art by providing a Speaker Side Air Supply Cabinet that eliminates the pull back on the outgoing sound wave by drawing in air though both of the Speaker Side Air Supply ducts from out side of the cabinet.

The following detailed description is, therefore, not to be taken in a limiting sense, and the scope of the present invention is best defined by the appended clams.

BRIEF DESCRIPTION OF THE DRAWING FIGURES

In order that the invention may more fully understood, it will now be described, by way of example, with reference to the accompanying drawings.

FIG. 7 is a flow chart of the method of operation of the present invention.

DESCRIPTION OF THE REFERENCE NUMBER

Figure 1:
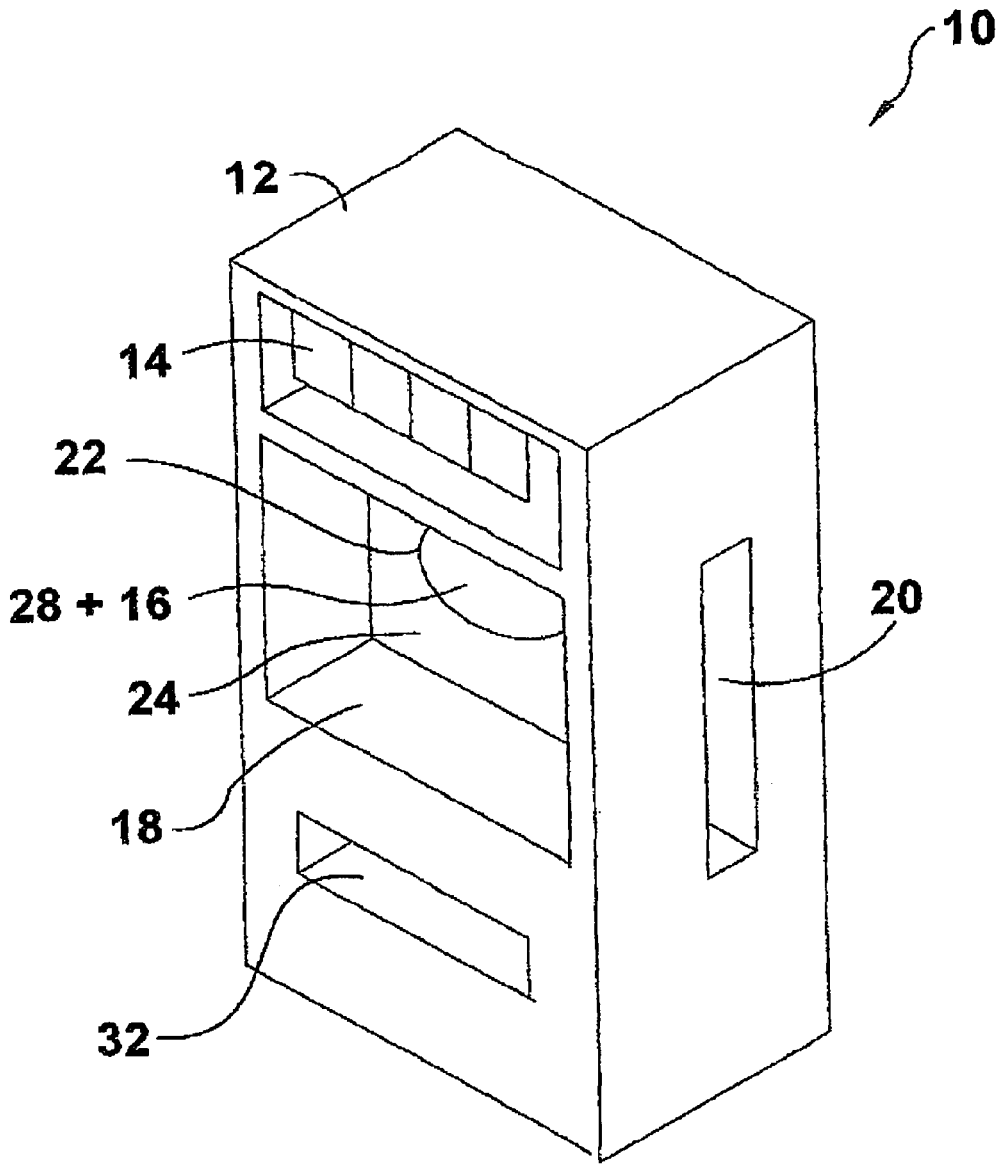
FIG. 1 is a perspective view of the present invention.

Turning now descriptively to the drawings, in which similar reference characters denote similar elements throughout the several views, the figures illustrate the Speaker Side Air Supply Cabinet of the present invention. With regard to the reference numerals used, the following is used throughout the various drawings figures.

10—Speaker Side Air Supply Cabinet of the present invention.
12—Cabinet
14—High end horn
16—Speaker cone
18—Bass horn
20—Speaker side air ducts
22—Restrictor plate opening
24—Restrictor plate
26—Distribution zone
28—Front air chamber
30—Air flow
32—Bass reflex Port
34—Sound wave

DETAILED DESCRIPTION OF PREFERRED EMBODIMENT

The following discussion describes in detail one embodiment of the invention {and several variations of the embodiment}. This discussion should not be construed, however, as limiting the invention to those particular embodiments; practitioners skilled in the art will recognize numerous other embodiments as well. For definition of the complete scope of the invention, the reader is directed to the appended claims.

FIG. 1. Is an illustrative view of the present invention 10, Shown is the present invention the Speaker Side Air Supply cabinet having a cabinet 12, with a high end horn 14, a bass horn 18, a speaker cone 16, front air chamber 28, a restrictor plate 24, a restrictor plate opening 22, a bass reflex port 32, and Speaker Side Air Supply ducts 20.

Figure 2:
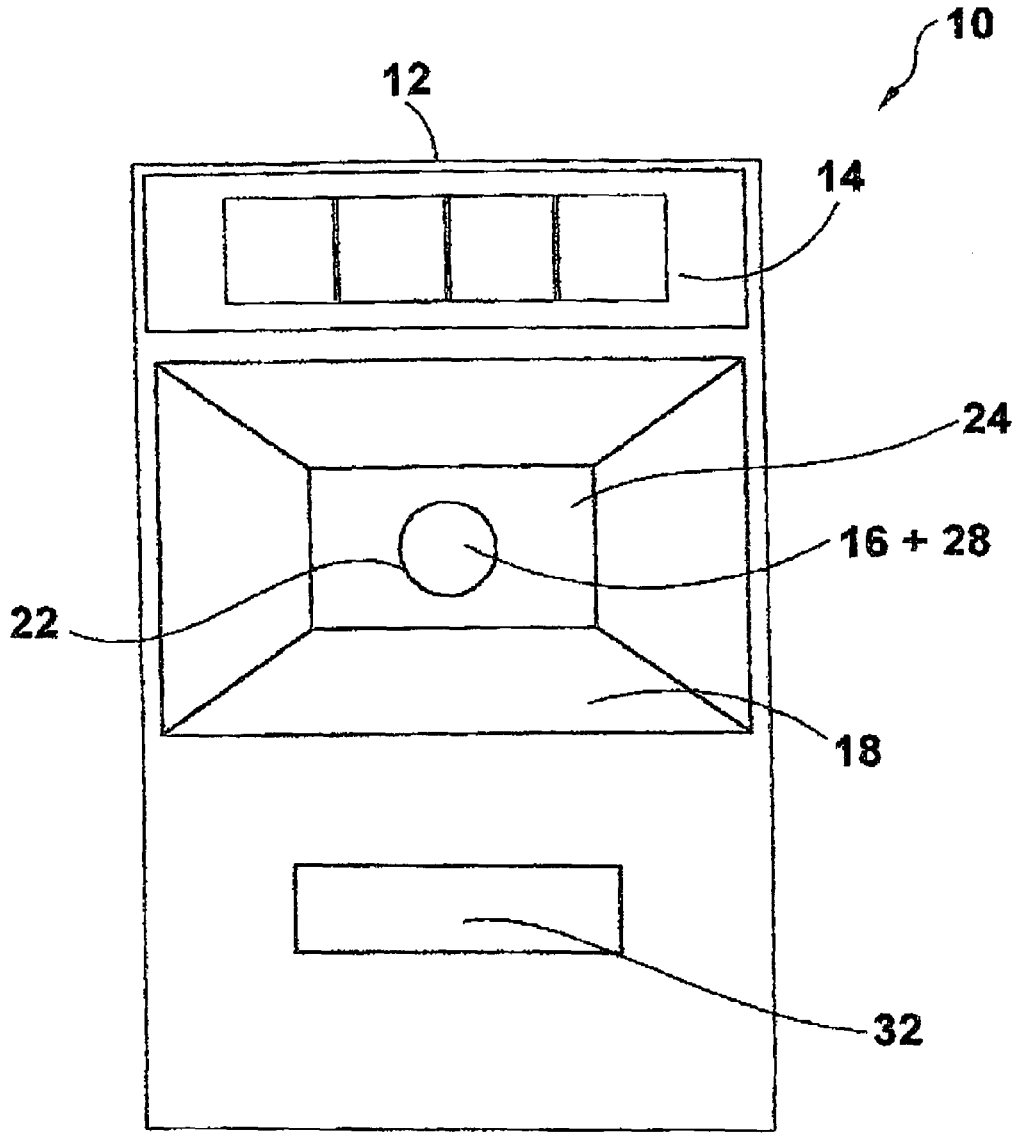
FIG. 2 is a front view of the present invention.

FIG. 2. Is a front view of the present invention 10, Shown is the Speaker Side Air Supply Cabinet 12, with a high end horn 14, a bass horn 18, a speaker cone 16, a front air chamber 28, a restrictor plate opening 22, a restrictor plate 24, and a bass reflex port 32.

Figure 3:
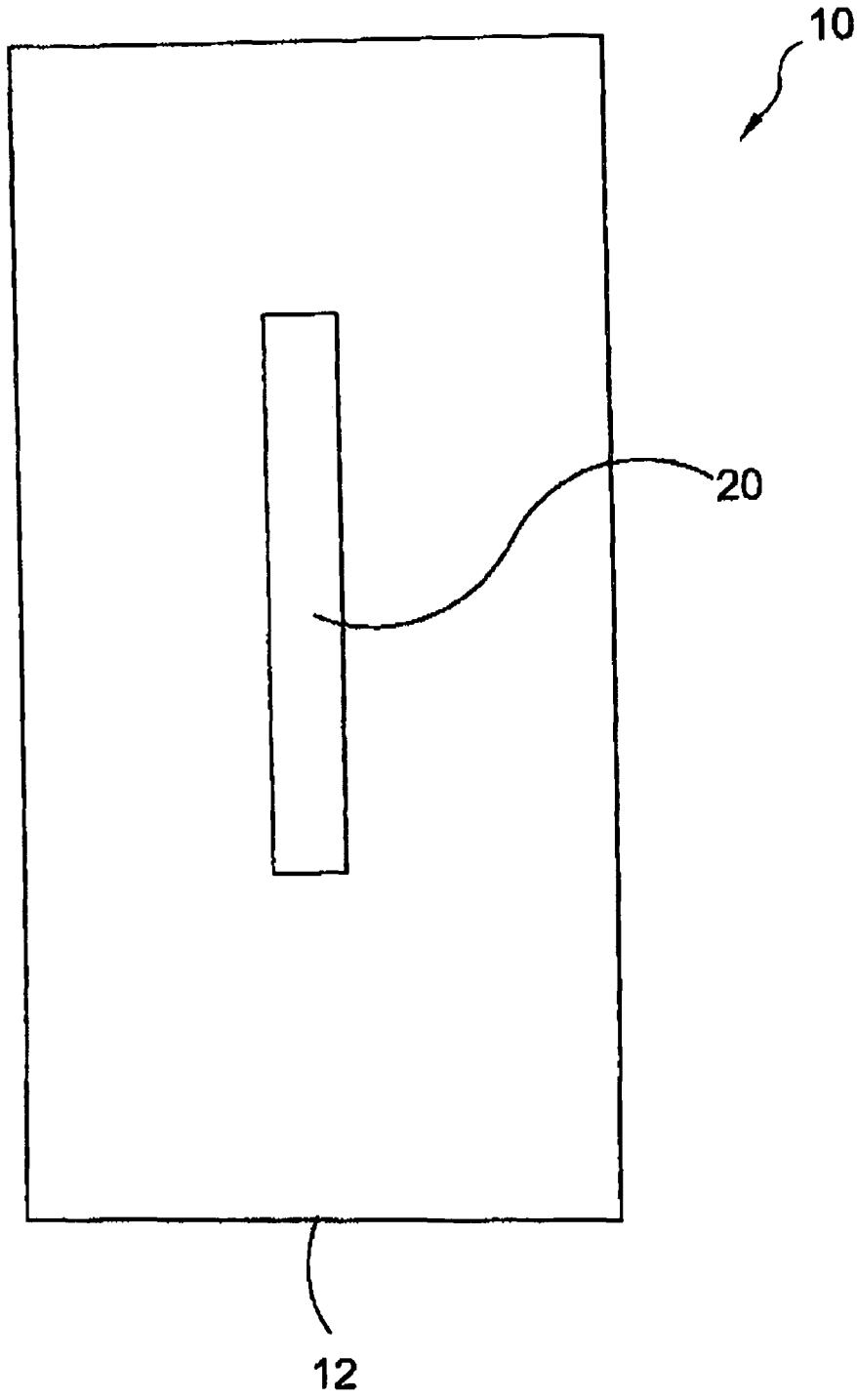
FIG. 3 is a side view of the present invention.

FIG. 3. Is a side view of the present invention 10, Shown is the Speaker Side Air Supply Cabinet 12, with a Speaker Side Air Supply duct opening 20.

Figure 4:
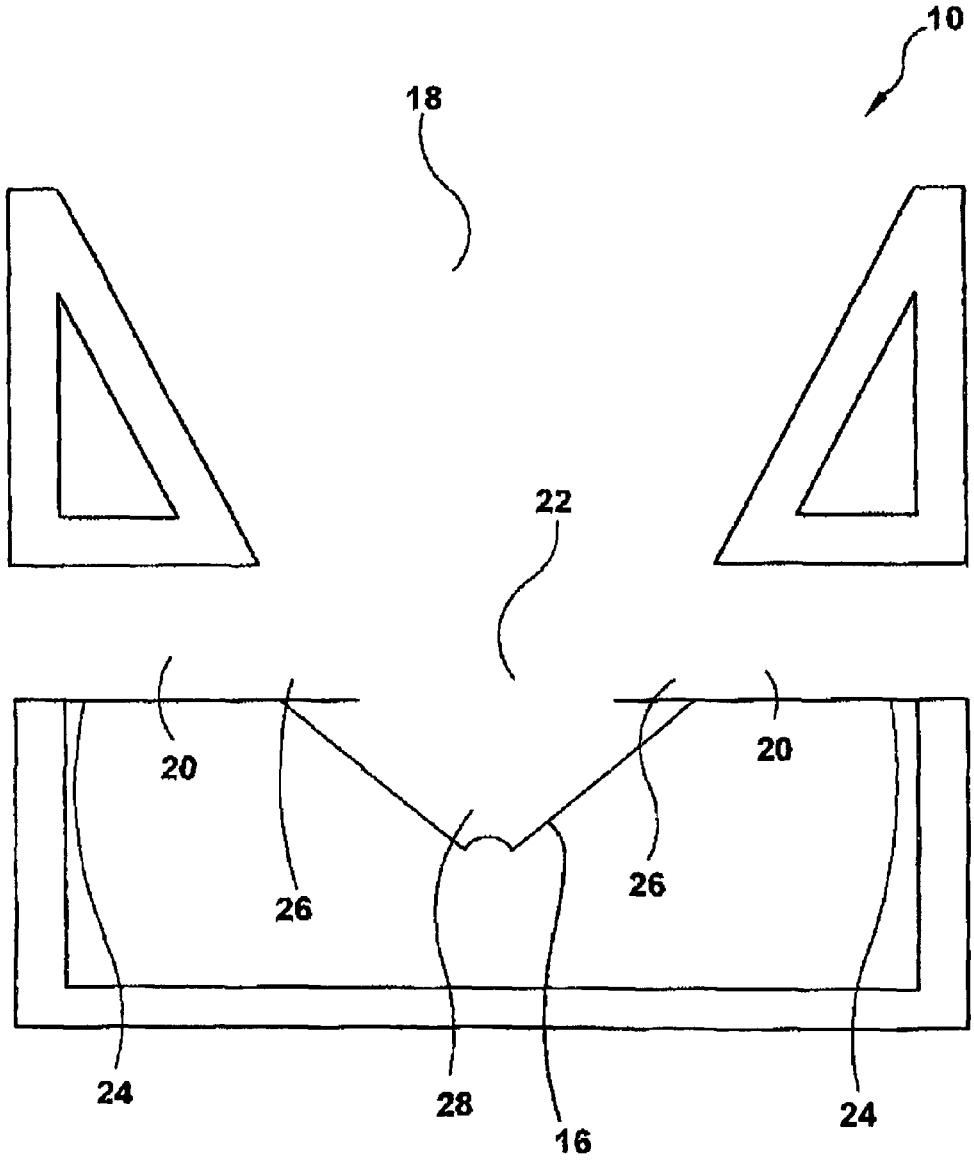
FIG. 4 is a top sectional view of the present invention.

FIG. 4. Is a top sectional view of the present invention 10, Shown is the Speaker Side Air Supply Cabinet 12 having a bass horn 18, a speaker cone 16, a restrictor plate 24, a restrictor plate opening 22, which make up the front air chamber 28, a pair of Distribution zone 26, and a pair of Speaker Side Air Supply ducts 20.

Figure 5:
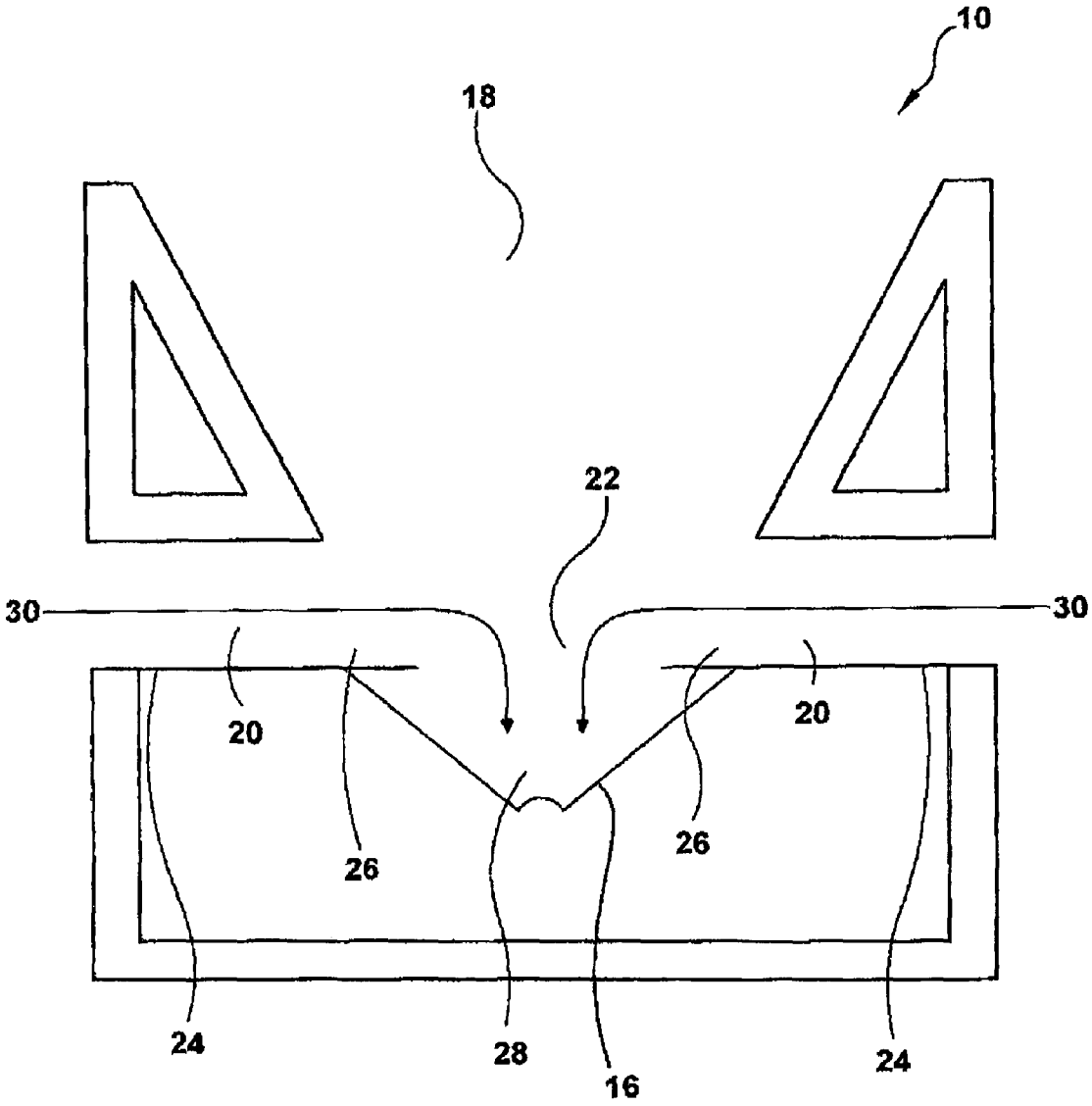
FIG. 5 is a top sectional view of the present invention in use, responding to a negative signal.

FIG. 5. Is a top sectional view of the present invention 10 in use. Shown is the Speaker Side Air Supply Cabinet 12 responding to negative signal. The speaker cone 16 is moving in an inward direction is creating a vacuum at the front of the speaker cone 16 and in the front air chamber 28, then though the restrictor plate opening 22, then in both of the Distribution zone 26, then in both of the Speaker Side Air Supply ducks 20. This then results in air flow 30 being drawn into the cabinet through the Speaker Side Air Supply ducts 20.

Figure 6:
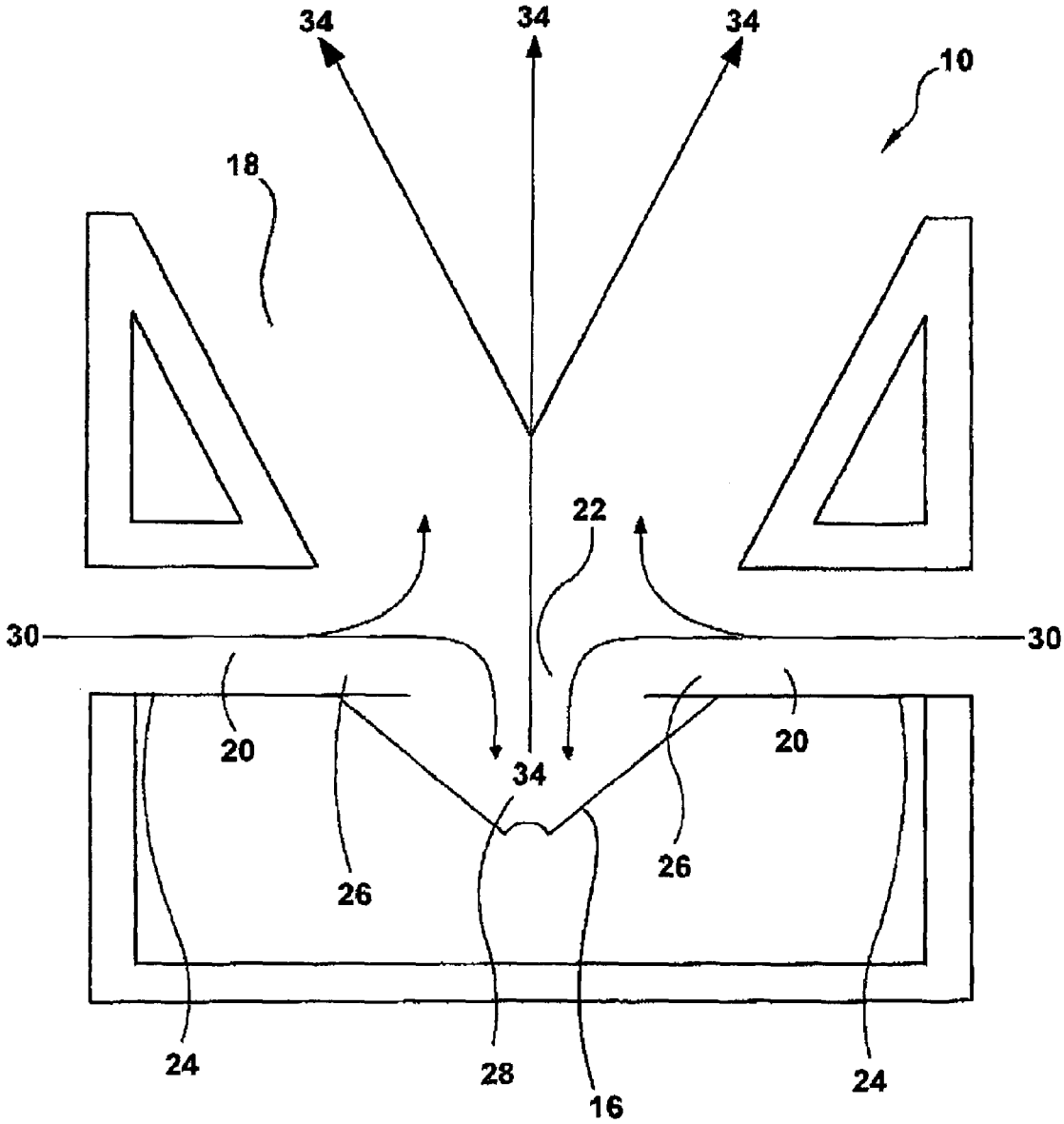
FIG. 6 is a top sectional view of the present invention in use, responding to a positive signal.

FIG. 6. Is a top sectional view of the present invention 10 in use. Shown is the Speaker Side Air Supply Cabinet 12 responding to a positive signal. The speaker cone 16 is moving in an outward direction is creating a positive air pressure {sound wave} 34, at the front of the speaker cone 16, and in the front air chamber 28, then going out the restrictor plate opening 22, then going out the bass horn 18, and creating a vacuum in both of the Distribution zones 26, and in both of the Speaker Side Air Supply ducts 20. The vacuum results in air flow 30, being drawn into the cabinet though both of the Speaker Side Air Supply ducts 20, from out side the cabinet to eliminate the pull back on the sound wave and supply air to the front air chamber at the same time.

FIG. 7 Is a flow chart of the method of operation of the present invention 10. With a negative signal applied to the Speaker Cone it starts moving in an inward direction generating a vacuum at the front of the Speaker Cone and in the Front Air Chamber, generating a vacuum at the Restrictor Plate Opening, generating a vacuum in both of the Distribution Zones, generating a vacuum in both of the Speaker Side Air Supply ducts, and drawing air through the Speaker Side Air Ducts from outside the cabinet to the Front Air Chamber so it can compress it for a higher sound wave output. With a positive signal applied to the Speaker. The speaker Cone it starts moving in an outward direction generating a positive air pressure at the front of the Speaker Cone and in the Front Air Chamber, then out the Restrictor Plate Opening and the sound wave moving forward out the Bass Horn, generates a vacuum in both of the Distribution Zone and in both of the Speaker Side Air Supply ducts drawing in air from out side of the cabinet and repeating cycles increases the vacuum, the Speaker Side Air Supply ducts then provide all the air needed to Bass Horn to eliminate the pull back on the sound wave and supply all air needed to the Front Air Chamber at the same time; this resulting in an increased output of clean low bass It will be understood that each of the elements described above, or two or more together may also find a useful application in other types of methods differing from the type described above.

While certain novel feature of this invention have been shown and described and are pointed out in the annexed claims, it is not to be limited to the detail above, since it will be understood that various omissions, modification, substitutions and changes in form and details of the device illustrated and in its operation can be made by those skilled in the art without departing in any from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic or specific aspects of this invention.

What is claimed is new and desired to be protected by Letters Patent is set forth in the appended claims:

1. A Speaker Side Air Supply cabinet comprising: a speaker cabinet with a bass horn; a speaker with a speaker cone; a restrictor plate with an opening; a pair of Distribution Zones; a pair of speaker side air supply ducts; wherein the speaker with a Speaker Cone is sealed to the restrictor plate with an opening to form a Front Air Chamber; wherein the pair of Distribution Zones are between both the Speaker Side Air Ducts and the Restrictor Plate Opening of the Front Air Chamber; and wherein the pair of Speaker Side Air Ducts go through to the outside of both sides of the cabinet to let air flow into the Front Air Chamber and the Bass Horn to eliminate a pull back on the sound wave.

2. The Speaker Side Air Supply Cabinet according to claim 1, where a negative signal starts the Speaker Cone moving in an inward direction generates a vacuum at the Speaker Cone and in the Front Air Chamber.

3. The Speaker Side Air Supply Cabinet according to claim 2, where the vacuum in the Front Air Chamber generates a vacuum in the Restrictor Plate Opening.

4. The Speaker Side Air Supply Cabinet according to claim 3, where the vacuum in the Restrictor Plate Opening generates a vacuum in both Distribution Zones.

5. The Speaker Side Air Supply Cabinet according to claim 4, where the vacuum in both of the Distribution Zone generates a vacuum in both Speaker Side Air Supply ducts.

6. The Speaker Side Air Supply Cabinet according to claim 5, that the vacuum in both of the Speaker Side Air Supply ducts then draws in air from out side the cabinet, to the Front Air Chamber so it can compress it and to Bass Horn to eliminate the pull back on the sound wave.

7. The Speaker Side Air Supply Cabinet according to claim 6, where a positive signal start the Speaker Cone moving in an outward direction generates a positive air pressure at the front of the Speaker Cone and in the Front Air Chamber.

8. The Speaker Side Air Supply Cabinet according to claim 7, where the positive air pressure in the Front Air Chamber creating a high positive air pressure at the Restrictor Plate Opening.

9. The Speaker Side Air Supply Cabinet according to claim 8, wherein the high positive air pressure at the Restrictor Plate opening is going forward and out the Bass Horn.

10. The Speaker Side Air Supply Cabinet according to claim 9, that the out going sound wave generates a vacuum in both of Distribution Zones and in both the Speaker Side Air Supply ducts that draws in air from out side the cabinet.

11. The Speaker Side Air Supply Cabinet according to claim 10, where the speaker responds to a negative signal at the same time that the sound wave is going out the Bass Horn generating an increase in the vacuum in both the Distribution Zones.

12. The Speaker Side Air Supply Cabinet according to claim 11, where the increased vacuum in the Distribution Zones also increases the vacuum in both the Speaker Side Air Supply ducts.

13. The Speaker Side Air Supply Cabinet according to claim 12, wherein the increased vacuum in the Speaker Side Air Supply ducts draws in even more air from both side, out side the cabinet, to the Bass Horn to eliminate the pull back on the out going sound wave and supply air to the Front Air Chamber so it can be filled with air at the same time for a higher sound pressure output.

14. A method of eliminating pull back of the sound wave by a speaker cabinet comprising these steps:

a. Providing a speaker cabinet having a speaker with the front of the cone, a Restrictor Plate with an opening that is sealed together witch makes up the Front Air Chamber, a pair of opposing Distribution Zones, a pair of opposing Speaker Side Air Supply ducts, and a Bass Horn;

b. Providing a negative signal the Speaker Cone start moving in an inward direction to generate a vacuum at the front of the Speaker Cone and in the Front Air Chamber;

c. Generating a vacuum in the Restrictor Plate Opening;

d. Generating a vacuum in both the Distribution Zones and in both the Speaker Side Air Supply ducts;

e. Drawing in air through the Speaker Side Air Supply ducts from both sides, out side of the cabinet;

f. Providing a positive signal starts moving the Speaker Cone in an outward direction creating a positive air pressure at the front of the Speaker Cone and in the Front Air Chamber;

g. The high positive air pressure {sound wave} going out the Restrictor Plate Opening and then out the Bass Horn;

h. The resulting sound wave going out the Bass Horn generates a vacuum in both of the Distribution Zones and in both of the Speaker Side Air Supply ducts;

i. The resulting vacuum in both of the Speaker Side Air Supply ducts draws in air from both sides, out side of the cabinet;

j. Then providing a negative signal to the Speaker Cone at the same time the sound wave is going out the Bass Horn thereby increases the vacuum in both the Distribution Zone and both Speaker Side Air Supply ducts resulting in more air being drawn in from both sides, out side of the cabinet;

k. This increased amount of air eliminates the pull back on the out going sound wave and supply air to the Front Air Chamber at the same time for a higher volume of sound output.

* * * * *